US007388555B1

(12) United States Patent
Mertel

(10) Patent No.: US 7,388,555 B1
(45) Date of Patent: Jun. 17, 2008

(54) ADJUSTABLE-FREQUENCY TWO-ELEMENT BOWTIE ANTENNA

(76) Inventor: Michael E. Mertel, 3222 78th NE., Medina, WA (US) 98039

( * ) Notice: Subject to any disclaimer, the term of this patent is extended or adjusted under 35 U.S.C. 154(b) by 0 days.

(21) Appl. No.: 11/684,530

(22) Filed: Mar. 9, 2007

(51) Int. Cl.
*H01Q 9/16* (2006.01)

(52) U.S. Cl. ..... 343/823; 343/815; 343/819

(58) Field of Classification Search ..... 343/792.5, 343/795, 814, 815, 816, 817, 819, 823, 833, 343/834, 835
See application file for complete search history.

(56) References Cited

U.S. PATENT DOCUMENTS

| | | | | | |
|---|---|---|---|---|---|
| 2,476,469 | A | * | 7/1949 | Walker | 343/823 |
| 2,632,107 | A | * | 3/1953 | Hlivjak | 343/724 |
| 2,967,300 | A | | 1/1961 | Haughawout | |
| 3,487,415 | A | | 12/1969 | Simons | |
| 3,653,056 | A | | 3/1972 | Peterson | |
| 3,683,391 | A | | 8/1972 | Callaghan | |
| 3,971,031 | A | * | 7/1976 | Burke | 343/744 |
| 4,028,709 | A | * | 6/1977 | Berkowitz et al. | 343/819 |
| 4,290,071 | A | | 9/1981 | Fenwick | |
| 4,604,628 | A | | 8/1986 | Cox | |
| 4,785,308 | A | * | 11/1988 | Newcomb | 343/795 |
| 5,061,944 | A | | 10/1991 | Powers et al. | |
| 5,189,435 | A | | 2/1993 | Yarsunas et al. | |
| 5,841,406 | A | | 11/1998 | Smith | |
| 5,865,390 | A | | 2/1999 | Iveges | |
| 5,945,962 | A | * | 8/1999 | Harrington et al. | 343/792.5 |
| 5,995,061 | A | | 11/1999 | Schiller | |
| 6,154,180 | A | | 11/2000 | Pardrick | |
| 6,300,912 | B1 | | 10/2001 | Pla | |
| 6,677,914 | B2 | | 1/2004 | Mertel | |

OTHER PUBLICATIONS

Gibson, William, "A Teletuned 10-Meter Beam," QST, Cover Page and p. 35, Aug. 1952.
Advertisement for "Cliff-Dweller" NEW-TRONICS, Model CD 40-75, QST, p. 138, Dec. 1964.
Advertisement for New-Tronics Cliff-Dweller™, QST, p. 109, date unknown.

* cited by examiner

*Primary Examiner*—Tho G Phan
(74) *Attorney, Agent, or Firm*—Lewis and Roca, LLP

(57) ABSTRACT

An adjustable-frequency two-element bowtie antenna includes a support member on which first and second non-conductive hollow element support arms are mounted. Each support arm includes first and second opposing segments. The first and second segments of each element support arm include a first section extending outwardly from the support member, a curved transition section, and a second section extending in a direction towards and joining the second section of the other element support arm. The spacing between the first sections of each segment of each element support arm increase as a function of the distance from the support member. A length-adjustable conductive member is disposed in each element support arm. Length adjusters are coupled to the conductive members to configure the lengths of antenna elements. A connector may be provided to couple a transmission-line to a pair of the conductive members comprising a driven element.

10 Claims, 1 Drawing Sheet

ADJUSTABLE-FREQUENCY TWO-ELEMENT BOWTIE ANTENNA

BACKGROUND

1. Technical Field

Figure 1:
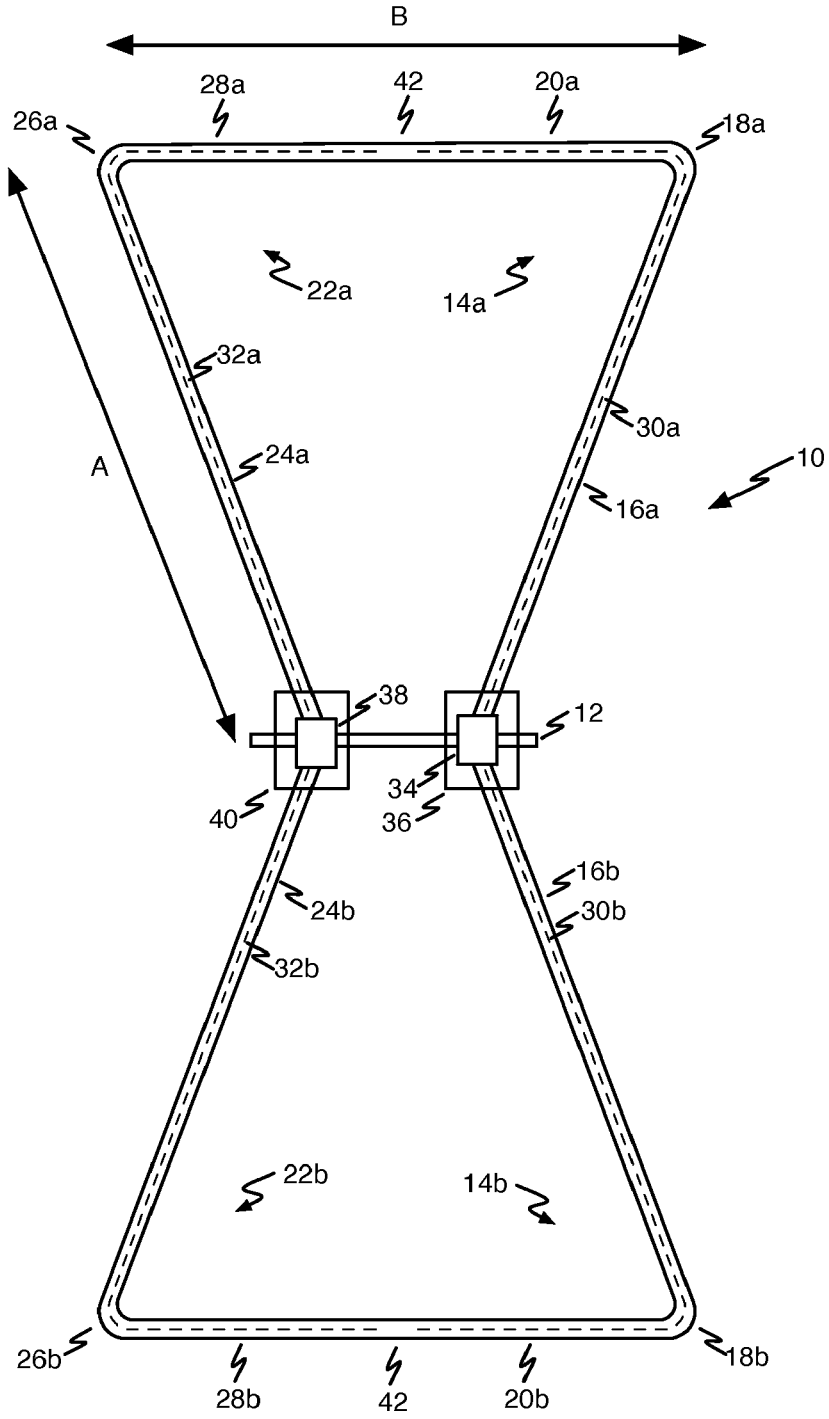

The present invention relates to the field of radio antennas, and to wide frequency coverage parasitic array antennas. More particularly, the present invention relates to adjustable antenna elements, and to antenna systems employing two such adjustable elements.

2. Description of the Prior Art

Antenna systems employing a single antenna having adjustable-length elements providing excellent performance over a wide frequency range are known in the art. Examples of such antenna systems are the antenna systems manufactured and sold as Steppir Antennas by Fluid Motion, Inc., of Issaquah, Wash., and include dipole, vertical, and yagi antennas.

A limiting factor in prior-art antennas is that, as the frequency of operation of the antenna becomes lower, the physical length of the antenna element must increase to allow it to resonate at the selected frequency. For example, in the case of a conventional yagi antenna having two or more elements extending outward from a boom support arm, element lengths of up to 70 feet are necessary for operation at frequencies in the 40-meter band (7.0 through 7.3 MHz). For operation in the 80 meter band (3.5 through 4.0 MHz) element lengths are up to 140 feet. Of course, elements such as loading coils can be used to shorten the physical lengths of the antenna elements, but they degrade the performance of the antenna.

Mechanical considerations for constructing such antennas become more complicated as the element lengths increase as the operating frequency decreases. Considerations such as mechanical stress and wind survivability make the design of such adjustable antenna systems more challenging when long element lengths are necessary. In addition, space considerations, rather than operating requirements, often dictate the maximum size of an antenna.

BRIEF DESCRIPTION

Disclosed herein is an adjustable-frequency two-element bowtie antenna that employs adjustable-length conductive members that are deployed in hollow support arms and use a length-adjusting mechanism such as a stepper motor for adjusting the length of the two conductive members inside the support arms.

The antenna of the present invention comprises a support member such as a boom on which first and second hollow element support arms are mounted. The element support arms are preferably disposed in a horizontal or vertical plane that passes through the support member. Each element support arm is formed from a non-conductive material. The first and second element support arms each include first and second opposing segments extending in opposite directions from the support member. The spacing between the first segments of each element support arm and the spacing between the second segments of each element support arm increase as a function of the distance from the support member. The first and second segments of each element support arm each include a first section extending outwardly from the support member for a length A, a curved transition section, and a second section extending for a length B/2 in a direction towards and joining the second section of the other element support arm. In one embodiment, the first section of each element support arm may be straight or may follow another function, including a curve, such as a segment of a parabola.

A length-adjustable conductive member is disposed in each hollow element support arm. A first length adjuster is coupled to and adjusts the lengths of the conductive members in the first and second segments of the first element support arm to configure a first antenna element. A second length adjuster is coupled to and adjusts the lengths of the conductive members in the first and second segments of the second element support arm to configure a second antenna element. A transmission-line is electrically coupled to the conductive members comprising a driven element. The first and second length adjusters are configured to extend the conductive members to a point where the distal ends of the first and second elements do not come into contact with one another but are spaced apart by a distance selected to prevent arcing at the power level to be applied to the antenna.

In one embodiment of the invention, the conductive member is adjusted by employing two spools located inside the housing unit in which the conductive member is wound. During use, the conductive member is selectively wound and unwound from a spool so that the conductive member moves inside the support arm. At least one motor is provided inside the housing unit that rotates the spool to precisely control the length of the conductive member inside the support arm.

In one embodiment of antenna systems where the adjustable antenna element is to be attached to a boom support structure, both ends of the hollow support arm are disposed in the same horizontal plane. One end of the hollow support arm is attached to the boom by a housing that contains the length adjuster apparatus. The other end of the hollow support arm is mechanically attached to the boom. In another embodiment of antenna systems where the adjustable antenna element is to be attached to a boom support structure, one end of the hollow support arm is attached to the boom by a housing that contains the length adjuster apparatus. The other end of the hollow support arm is disposed at a vertical position either above or below the boom and may be mechanically attached to the boom using a suitable support bracket.

An electronic control system may be coupled to each length adjuster and may be operated to manually adjust the length of the conductive members inside the driven and parasitic elements of the antenna to resonate at and thus efficiently receive or transmit a desired frequency. The electronic control system may also be operated in an automatic mode to adjust the length of the conductive members inside the driven and parasitic elements of the antenna from, for example, data stored in a memory, or from feedback from standing-wave-ratio (SWR) measuring apparatus or the like to resonate at and thus efficiently receive or transmit on a desired frequency.

BRIEF DESCRIPTION OF THE DRAWING FIGURES

FIG. 1 is a drawing depicting an adjustable-frequency two-element bowtie antenna according to one embodiment of the present invention.

DETAILED DESCRIPTION

Those of ordinary skill in the art will realize that the following description of the present invention is illustrative only and not in any way limiting. Other embodiments of the invention will readily suggest themselves to such skilled persons.

The present invention employs some of the principles disclosed in U.S. Pat. No. 6,677,914. The entire disclosure of U.S. Pat. No. 6,677,914 is expressly incorporated herein by reference.

Referring first to FIG. 1, a diagram shows an illustrative embodiment of an adjustable-frequency two-element bowtie antenna according to the present invention. Antenna 10 includes a support member in the form of a boom 12 on which two element support arms are mounted. The first element support arm includes first and second segments 14*a* and 14*b*. First segment 14*a* includes a first section 16*a*, a transition section 18*a*, and a second section 20*a*. Second segment 14*b* includes a first section 16*b*, a transition section 18*b*, and a second section 20*b*. The second element support arm includes first and second segments 22*a* and 22*b*. First segment 22*a* includes a first section 24*a*, a transition section 26*a*, and a second section 28*a*. Second segment 22*b* includes a first section 24*b*, a transition section 26*b*, and a second section 28*b*.

The first and second segments 14*a* and 14*b* of the first element support arm each have a length-adjustable conductive member 30*a* and 30*b*, respectively, disposed therein. Similarly, the first and second segments 22*a* and 22*b* of the first element support arm each have a length-adjustable conductive member 32*a* and 32*b*, respectively, disposed therein.

Length-adjustable conductive members 30*a* and 30*b* are coupled to a length adjuster 34 disposed in housing 36. Housing 36 also serves to provide mechanical support to attach the element support arm segments 14*a* and 14*b*. Similarly, length-adjustable conductive members 32*a* and 32*b* are coupled to a length adjuster 38 disposed in housing 40. Housing 40 also serves to provide mechanical support to attach the element support arm segments 22*a* and 22*b*. As presently preferred, length-adjustable conductive members 30*a*, 30*b*, 32*a*, and 32*b* are formed from a flexible conductive strip formed from a material such as beryllium copper, and the length adjusters and housings 36 and 40 may be configured as disclosed in U.S. Pat. No. 6,677,914, expressly incorporated herein by reference.

As will be appreciated by persons of ordinary skill in the art, the size of the antenna 10 (element length) depends on the frequency range of interest. As an example, in an antenna according to the present invention designed to operate at frequencies within the 6M through 20M bands, the dimension A should be about 13 feet and the dimension B should be about 8 feet. In such an antenna, the elements should be spaced from one another at the boom by about 42 inches. Such skilled persons will readily understand from the example disclosed herein how the dimensions will scale for the design of antennas for other frequency ranges according to the present invention.

When the length-adjustable conductive members 30*a*, 30*b*, 32*a*, and 32*b* turn the corners at transition sections 18*a*, 18*b*, 26*a*, and 26*b*, the antenna starts to behave as a Moxon antenna. At full extension, the tips of length-adjustable conductive members 30*a*, 30*b*, 32*a*, and 32*b* should be separated by enough to avoid arcing at the power to be used. This spacing (shown at reference numeral 42) may be about 10 inches for a few kilowatts of applied power.

The length adjusters disposed in housings 34 and 36 may be controlled using a stepper motor controller in the manner disclosed in U.S. Pat. No. 6,677,914, expressly incorporated herein by reference.

The impedance at the feedpoint of antenna 10 is advantageously selected to be proximate to where the length-adjustable conductive members emerge from the length adjusters and is between about 20 ohms and about 30 ohms. This impedance remains relatively constant as a function of element length. Appropriate well-known transmission line matching techniques, including the use of impedance transformers such as baluns, ununs, etc., may be employed to impedance match antenna 10 to a selected transmission line as is known in the art. An advantage of the antenna of the present invention is that it is shorter in length (elements) than a fixed conventional two-element antenna.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An adjustable-frequency two-element bowtie antenna, comprising:

a support member;

first and second hollow element support arms mounted to the support member and formed from a non-conductive material, the first and second element support arms each including first and second opposing segments extending in opposite directions from the support member, the first and second segments of each element support arm each including a first section extending outwardly from the support member, a curved transition section, and a second section extending in a direction towards and joining the second section of the other element support arm, the spacing between the first section of each segment of each element support arm increasing as a function of the distance from the support member;

a length-adjustable conductive member disposed in each hollow element support arm;

a first length adjuster coupled to the conductive members in the first and second segments of the first element support arm to configure a first antenna element;

a second length adjuster is coupled to the conductive members in the first and second segments of the second element support arm to configure a second antenna element; and a coupling configured to receive a transmission-line electrically coupled to a pair of the conductive members comprising a driven element.

2. The antenna of claim 1 wherein the first and second length adjusters are configured to extend the conductive members to a point where the distal ends of the first and second elements are spaced apart by a minimum distance selected to prevent arcing.

3. The antenna of claim 1, wherein the first section of each element support arm is substantially straight.

4. The antenna of claim 1, wherein the first section of each element support arm describes a segment of a parabola.

5. The antenna of claim 1, further including a controller coupled to the first and second length adjusters.

6. The antenna of claim 1 wherein the support member is a boom.

7. The antenna of claim 6 wherein the element support arms are disposed substantially in a plane that is tangential to the boom.

8. The antenna of claim 7 wherein the element support arms are disposed in a substantially horizontal plane that is tangential to the boom.

9. The antenna of claim 7 wherein the element support arms are disposed in a substantially vertical plane that passes through the boom.

10. The antenna of claim 7 wherein the length adjusters each include stepper motors.

* * * * *